US005572816A

United States Patent [19]

Anderson, Jr. et al.

[11] Patent Number: 5,572,816

[45] Date of Patent: Nov. 12, 1996

[54] ROTATING ADVERTISING SIGN WITH ROTATING LOUVERS

[75] Inventors: Taz L. Anderson, Jr., Atlanta; Todd W. Stalder, Alpharetta, both of Ga.

[73] Assignee: Multimedia Technologies, Inc., Atlanta, Ga.

[21] Appl. No.: 171,924

[22] Filed: Dec. 21, 1993

[51] Int. Cl.[6] ..... G09F 11/02; G09F 13/12

[52] U.S. Cl. ..... 40/505; 40/502; 40/503

[58] Field of Search ..... 40/493, 502, 505, 40/503, 473, 494; 422/36, 43; 52/27, 29, 38, 192, 245, 246, 502, 503, 505

[56] References Cited

U.S. PATENT DOCUMENTS

| | | | |
|---|---|---|---|
| 369,623 | 9/1887 | Totten | 472/12 |
| 739,127 | 9/1903 | Ward et al. . | |
| 1,238,960 | 9/1917 | Torrey | 40/505 |
| 1,855,522 | 4/1932 | Lando . | |
| 2,102,550 | 12/1937 | Treesh . | |
| 2,830,395 | 4/1958 | Hutchens | 40/502 |
| 3,757,108 | 9/1973 | Burland | 240/46.59 |
| 5,297,353 | 3/1994 | Ghalayini | 40/505 |

*Primary Examiner*—Kenneth J. Dorner
*Assistant Examiner*—Cassandra Davis
*Attorney, Agent, or Firm*—Hopkins & Thomas

[57] ABSTRACT

The sign (10) includes a plurality of elongated louvers (170) arranged parallel to one another in a cylindrical array to form a carousel (30) of louvers rotatable about a central axis (15). Each louver (170) is rotatable about is own length to display different images, with the images of adjacent louvers being coherent to form a progressive coherent image about the carousel, and the louvers are turned on their own axes in timed relationship with respect to one another, either simultaneously or progressively, to change the images. Sign (10) has a circular frame (30) which is rotatably supported on a support base (20). Frame (30) has twelve panel frames (36) which are interconnected to form one rigid circular frame assembly (30) about central axis (15). Three drive wheel assemblies (70) are provided for rotating advertising sign (10) about central axis (15). The revolving louver assembly (94) of sign (10) has a louver drive box assembly (96), a louver drive system (132), a louver support beam (164) having a plurality of louver support pins (166), and a plurality of vertical louvers (170) for displaying advertisements. As advertising sign (10) is rotated about central axis (15), each louver (170) is rotated about its length to display one of three different advertising signs at three different times.

26 Claims, 7 Drawing Sheets

ROTATING ADVERTISING SIGN WITH ROTATING LOUVERS

FIELD OF THE INVENTION

This invention relates to outdoor advertising signs. More particularly, this invention relates to a revolving outdoor advertising sign having an array of revolving display louvers supported thereon.

BACKGROUND OF THE INVENTION

Manufacturers, retailers, and other business concerns have long sought to sell goods and services by advertising the availability of their products or services to the public. In hand with this, advertising firms have sought to create and market advertising signage which is unique and will not only catch the public's collective eye, but also turn its attention toward the goods and services offered for sale. Advertising sign manufacturers and inventors have worked to meet this demand by designing and manufacturing outdoor display and signage devices which will be readily noticed by the consuming public, and will effectively communicate the advertiser's message to the public in order to promote sales of the goods or services advertised.

As those in the field of art are aware, initial attempts to advertise products for sale used little more than stationary billboards or plaques having an advertising sign displayed on the face thereof. Some of these prior art billboards were equipped to display advertising on both sides. The sides of these prior art billboards were then exposed to public view. Both advertisers and advertising sign manufacturers, however, sought ways to maximize both the return on their investment in advertising costs, and in the manufacture of advertising displays, respectively.

An early disclosure of a display device is found in U.S. Pat. No. 1,855,522 to H. Lando, issued Apr. 26, 1932. This patent discloses a display device having a plurality of display plates enclosed in a first housing and a second transparent housing spaced apart and enclosing the first housing. The display plates are illuminated internally, and revolve about a point inside the first housing while a fountain plays between the two housings to attract the public's view.

Another advertising sign is disclosed in U.S. Pat. No. 2,102,550, to M. C. Treesh, issued Dec. 14, 1937. In Treesh, a revolving cylindrical sign is supported on a vertical pole passing through the housing. The advertising sign of Treesh rotates on the support pole and it has colored neon lights on its exterior to draw the public's attention to the advertisement on the revolving face of the sign.

A different approach to a revolving advertising sign is disclosed in U.S. Pat. No. 2,830,395, to H. T. Hutchens, issued Apr. 15, 1958. In Hutchens, a rotating cylindrical advertising sign is supported on a central pole as in Treesh. However, and unlike Treesh, the advertising sign of Hutchens is formed of a cylindrical translucent plastic glass which has pairs of spaced apart bands extending thereabout for holding lettering or other symbols to create an advertising sign. The sign is illuminated from the inside. As with the advertising sign of Treesh, the advertising sign of Hutchens is driven by a drive mechanism located inside the sign housing. Hutchens, however, teaches that in addition to having a revolving portion of the advertising sign, there also can be a stationery portion of the advertising sign supported above the revolving portion of the sign which is visible above the sign by passers by.

Thus, it is known in the art to have revolving advertising signs with an advertising sign or billboard contained on its face which can be seen by the public. These prior art signs, however, have become commonplace, and one advertising sign is thus no more noticeable than the preceding, or subsequent, advertising signs observed by the public. Therefore, it would be desirable to provide an advertising sign which has a cylindrical display surface formed by a plurality of changeable surfaces which revolve about a common central axis and which rotate on their own axes, and which will draw the public's attention to the sign, as well as to the advertisements displayed on the sign.

SUMMARY OF THE INVENTION

Briefly described, the invention comprises a revolving cylindrical advertising sign having a structural frame upon which an array of three sided triangular louvers are carried. As the advertising sign revolves about a central axis, each of the louvers rotates about its length for displaying one of three different advertising signs at different times during the sign's revolution. In so doing, the public's attention is caught not only by the shape and size of the advertising sign, but also by the rotating motion of both the sign and the louvers which make up the sign.

The advertising sign includes a structural frame which is supported for rotation about an upright central axis. The sign includes at least one drive wheel assembly for rotating the frame about the central axis, and a plurality of three sided elongated louvers rotatably supported on the frame. The louvers are arranged in an upright cylindrical array on the frame, about the central axis, with the louvers positioned closely adjacent one another for forming a generally cylindrical and continuous advertising sign surface.

The advertising sign also has a louver drive system for rotating the louvers about their lengths, whereby the louvers move with the frame and revolve about their own axes. In so doing the louvers rotate into position for outwardly displaying one of three different advertising signs at different times during the revolution of the advertising sign.

The frame of the advertising sign comprises a circular structural steel frame having twelve panel frames spaced equally apart from each other radially about the central axis. A circular inner hub beam is connected to the proximal end of each panel frame closest to the central axis, and a circular outer rim beam is connected to the distal end of each panel frame. Both the inner hub beam and outer rim beam lie in a common plane. The frame is rotatably supported on a structural support base by a plurality of spaced apart support wheels mounted on the inner hub beam of the frame which extend downwardly and are engaged with the support base, and by a plurality of spaced apart upwardly extending idler wheels mounted on the support base below, and which are engaged with, the bottom flange of the frame's circular outer rim beam. The support wheels fix the frame in position about the axis and rotatably support the frame as it revolves about the central axis.

Each of the louvers is triangular in shape and has a top and a bottom plate so that each louver is formed as an enclosed hollow elongated triangular shape. Each louver is separately supported on the frame and rotated about its length by the louver drive system. The frame is rotated about the central axis by the sign's drive wheel assembly which is mounted on the support base and which is engaged with the bottom flange of the frame's outer rim beam.

In contrast to earlier revolving advertising signs, the advertising sign provides a novel way to both catch the eye of the public and to maximize the advertising signage available on the advertising sign in that our advertising sign is effectively three advertising signs, each visible at different times. Due to the time and expense involved in manufacturing stationary or prior art revolving signs, our invention minimizes the advertising sign owner's costs to fabricate and install an advertising sign, and the advertisers' costs to advertise, by providing a unique and eye catching advertising display which will be easily recognized and remembered by the public while also providing a way for the advertising sign owner to sell three times the advertising display space on one advertising sign.

Accordingly, it is an object of the present invention to provide an improved advertising sign for a prime location which provides three times the advertising space of a single advertising sign in one apparatus.

Another object of the present invention is to provide an advertising sign that is inexpensive to manufacture and maintain, is durable and will provide a long service life, and which is adaptable for use in existing or new advertising locations.

It is another object of the present invention to provide a spectacular revolving advertising sign having a revolving cylindrical surface constructed of an array of individual vertical louvers which are individually rotated about their lengths as the sign revolves about a central axis, so as to expose three different advertising signs in a relatively short period of time.

Another object of the invention is to provide a multiple compact image sign which revolves and provides a progressively changeable message to the viewer.

Other objects, features, and advantages of the invention will become apparent upon reading the specification when taken in conjunction with the accompanying drawings.

DETAILED DESCRIPTION OF THE PREFERRED EMBODIMENT

Figure 1:
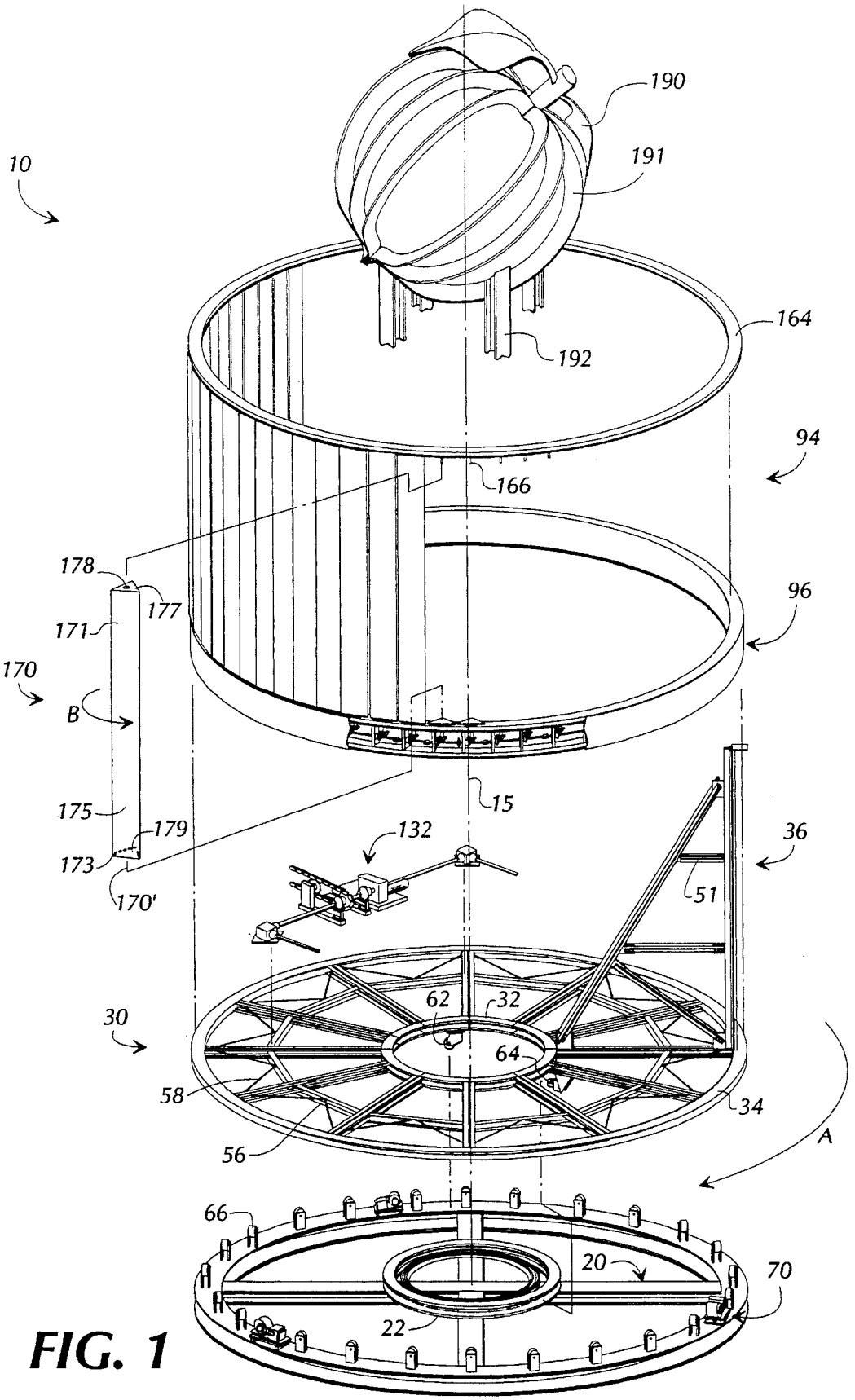
FIG. 1 is an exploded perspective partially cut-away view of a preferred embodiment of the advertising sign.

Referring now in more detail to the drawings, in which like reference numerals indicated like parts throughout the several views, FIG. 1 illustrates advertising sign 10 which has a support base 20 on which frame 30 is supported. Sign 10 also includes revolving louver assembly 94 which is mounted on frame 30 which functions as a carousel. Revolving louver assembly 94 has a louver drive box assembly 96, a circular louver support beam 164 positioned above louver drive box assembly 96, with a plurality of louver support pins 166 extending downward from louver support beam 164 in matching number to each one of louvers 170 mounted on revolving louver assembly 94. Still referring to FIG. 1, advertising sign 10 also has an advertising structure 190 supported above revolving louver assembly 94 on vertical support columns 192, which are in turn fastened to support base 20.

Figure 4:
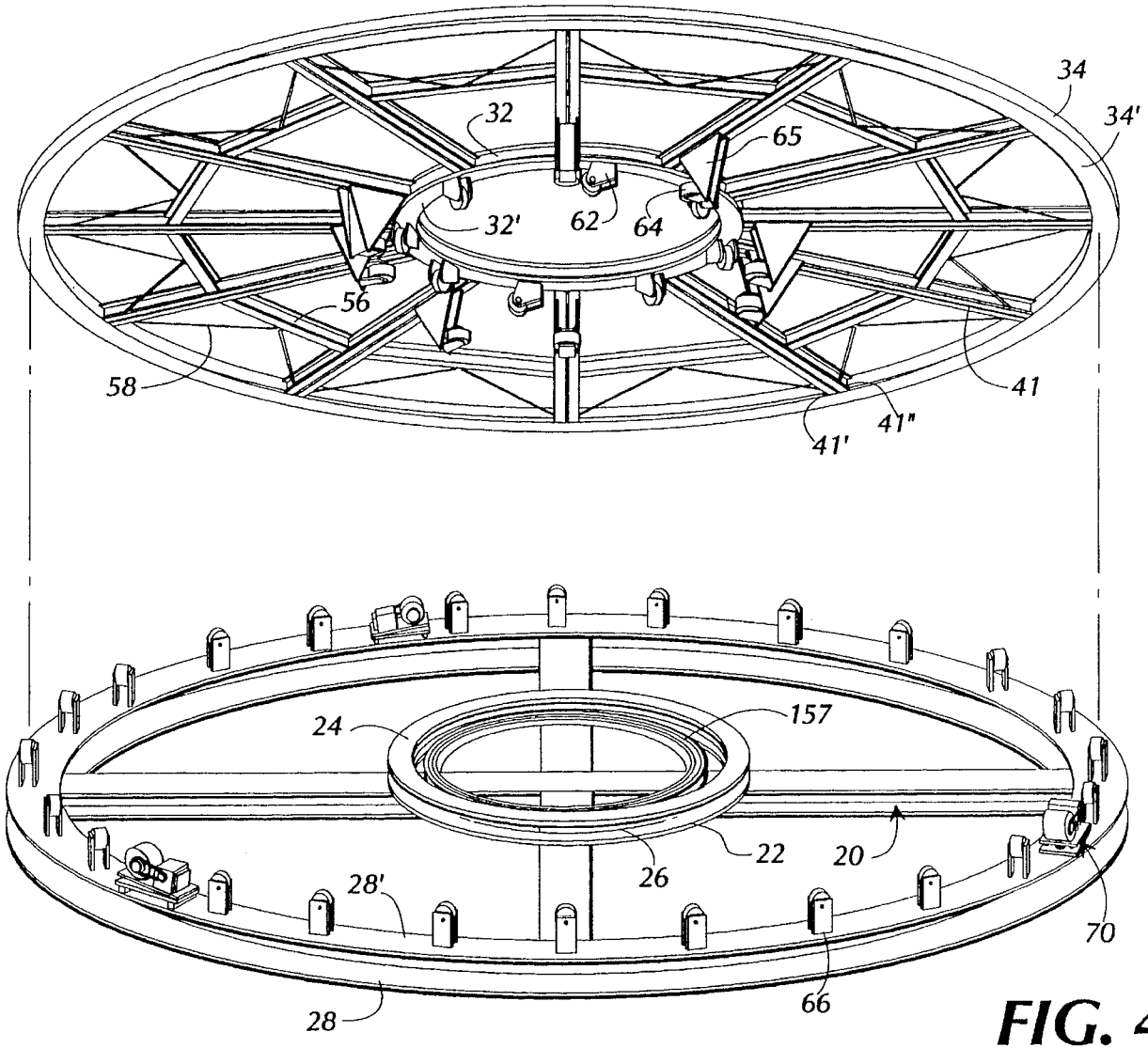
FIG. 4 are perspective views of the support base and the bottom of the advertising sign frame.

Advertising sign 10, as illustrated in FIGS. 1 and 4, is revolved around central upright axis 15 by three drive wheel assemblies 70. Each drive wheel assembly 70 is mounted on support base 20. The individual components and/or systems of advertising 10 will now be discussed in greater detail.

Referring to FIGS. 1 and 4, advertising sign 10 is both supported, and rotates, on support base 20. Support base 20 is constructed of structural steel I-beams. Support base 20 also has an inner circular hub support beam 22. Hub support beam 22 is provided with a top flange 24, and a web 26. Support base 20, hub support beam 22, and outer rim I-beam 28 are conventional structural steel I-beams which are formed to shape. Although support base 20 is shown as having two steel I-beams lying underneath a circular outer rim I-beam 28, support base 20 can be built in any configuration so long as it provides structural support for mounting and properly positioning drive wheel assemblies 70, and idler wheel assemblies 66. All of the structural steel in support base 20, hub support beam 22, and outer rim I-beam 28 is painted with a prime coat to prolong the life of the structural steel and to deter the spread of corrosion on or in the steel. Support base 20, hub support beam 22 and outer rim I-beam 28 can be finish painted in any desired color to match the surroundings in which advertising sign 10 has been installed, or for any particular aesthetic concerns or municipal code requirements.

Frame 30, as illustrated in FIGS. 1 through 4, is constructed of both structural steel and steel angle and channel members. Those skilled in the art will be aware that the steel angles and channel beams used to make frame 30 are also referred to as angle iron. Referring now to FIG. 1, frame 30 has a circular inner hub beam 32 and a circular outer rim beam 34, both of which are located in a common horizontal plane above support base 20. Both inner hub beam 32 and outer rim beam 34 are constructed of steel I-beams which are fabricated into one continuous circular inner hub beam 32, and one continuous circular outer rim beam 34. Due to the circular shape of advertising sign 10, both inner hub beam 32 and outer rim beam 34 lie along the circumference of separate concentric circles about central axis 15.

Figure 2:
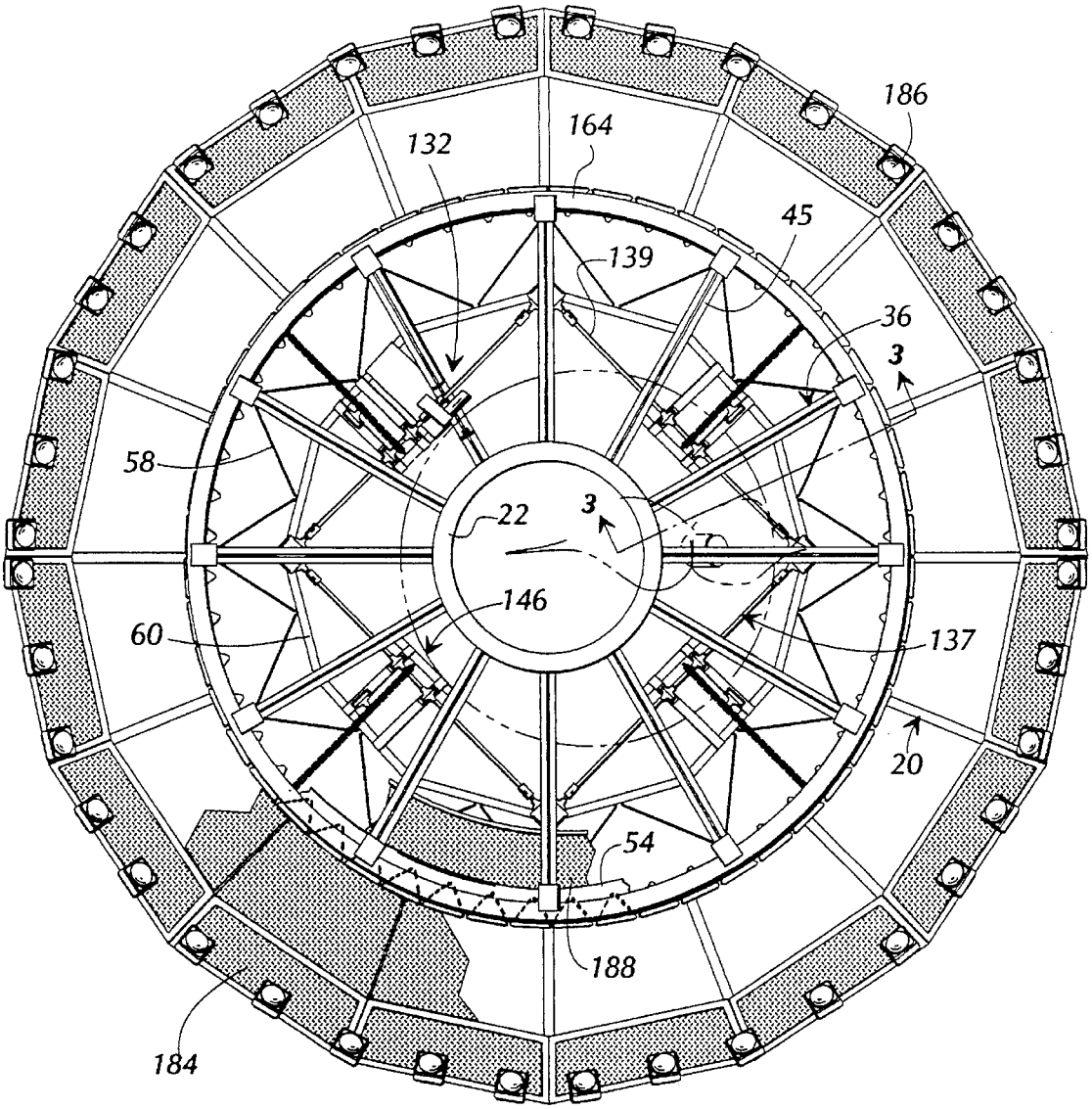
FIG. 2 is a top plan view of the advertising sign.

Referring now to FIGS. 1 and 2, frame 30 has a number of panel frames 36, each of which is connected at its proximal end 37 to inner hub beam 32, and at its distal end 39 to outer rim beam 34. As best shown in FIG. 2, there are a total of twelve panel frames 36 in our invention which are spaced equally from and radially about central axis 15. Each of panel frames 36 is radially spaced 30 degrees from each adjacent panel frame 36 about central axis 15.

Panel frame 36 is illustrated in greater detail in FIG. 3, which again illustrates that proximal end 37 of panel frame 36 is connected to inner hub beam 32 and that distal end 39 of panel frame 36 is connected to outer rim beam 34. Each panel frame has a base member 41 running horizontally between inner hub beam 32 and outer rim beam 34 along a radial line emanating from central axis 15 (FIG. 2). Base member 41 is bolted at each end 37, 39 to inner hub beam 32 and outer rim beam 34, respectively. A vertical support member 43 is bolted to a gusset plate 53 located at the distal end 39 of panel frame 36. An angled member 45 is bolted to the proximal end 37 of panel frame 36 and to the upper end 43' of support member 43 at gusset plates 53. Still referring to FIG. 3, panel frame 36 is given structural strength and rigidity by a first brace member 47 bolted to gusset plate 53 at the distal end 39 of panel frame 36, and bolted to angled member 45 at gusset plate 53'. A second brace member 49 is also bolted to support member 43 and angled member 45. A catwalk support 51, is also provided on panel frame 36, and as with braces 47 and 49, is bolted on both support member 43 and angled member 45 for providing a support for internal catwalk 188.

Referring now to FIGS. 1 and 4, each of panel frames 36 is connected to each adjacent panel frame 36 by a bottom cross brace 56, and by two tie-rods 58 extending from the distal end 39 of panel frame 36 to bottom cross brace 56. Each tie-rod 58 is bolted to both panel frame 36 and bottom cross brace 56. Each of bottom cross braces 56 is bolted to the mid point of bottom support member 41 of panel frame 36. (FIG. 4). Tie-rod 58 is bolted to distal end 39 of panel frame 36 and bolted (not illustrated) to bottom cross brace 56. Once bottom cross brace 56 and tie-rods 58 have been connected to each of panel frames 36, as shown in FIGS. 1 and 4, the bottom of frame 30 forms a circular structural steel frame which is rigid in structure and will support revolving louver assembly 94.

Figure 3:
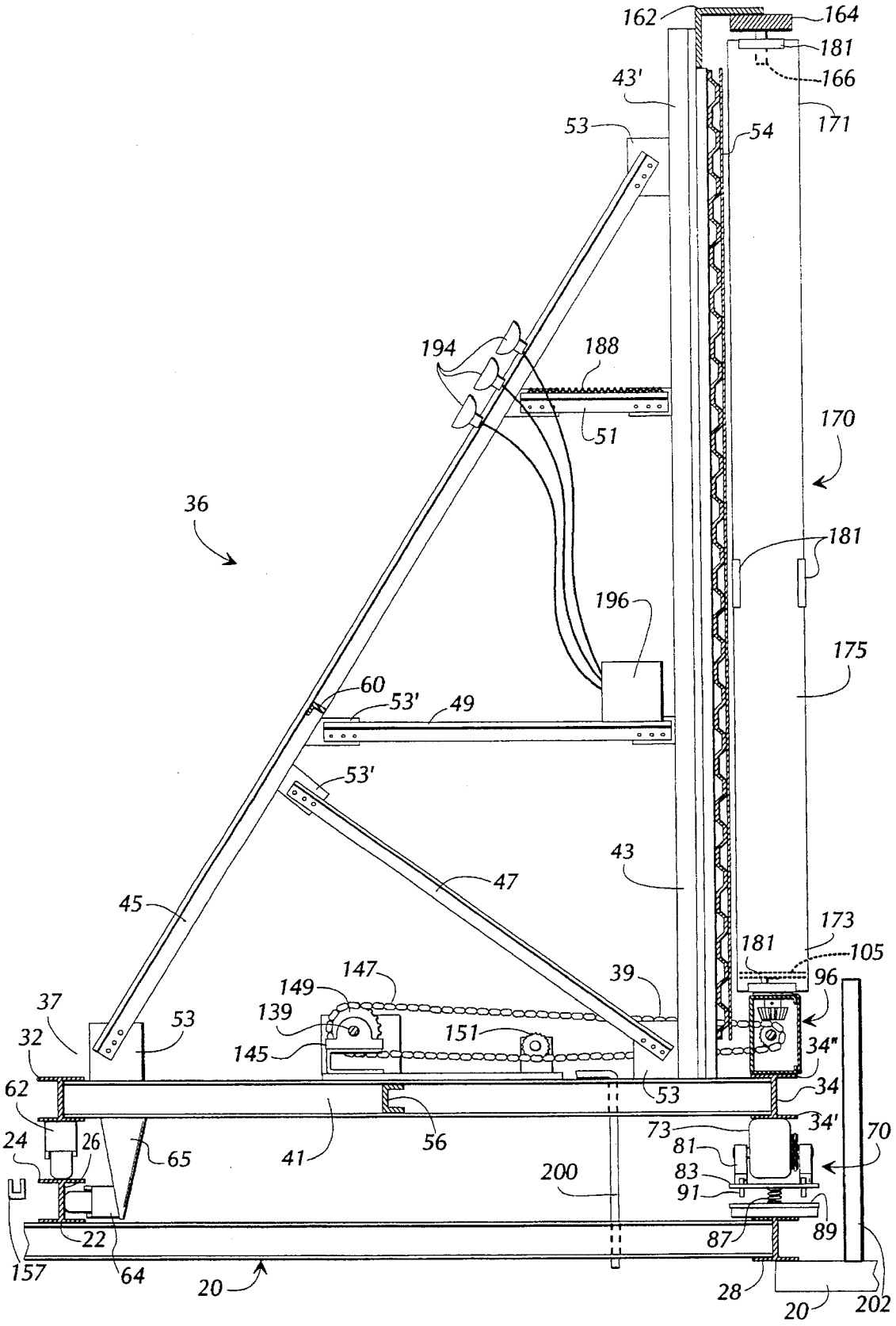
FIG. 3 is a side elevational view of half of the advertising sign frame and support base, taken along lines 3—3 of FIG. 2.

Referring now to FIG. 2, each of panel frames 36 is also connected to each adjacent panel frame 36 by a top cross brace 60. Top cross brace 60 is bolted to angled member 45 of panel frame 36 at its mid point, as shown in FIG. 2 and FIG. 3.

With the exception of inner hub beam 32 and outer hub beam 34, frame 30, to include each of panel frames 36, and bottom cross braces 56, tie-rods 58, and top cross braces 60 is constructed of steel angles and channel beams. For example, referring now to FIG. 3, base member 41 of panel frame 36 is constructed of two back-to-back channel sections, each having a "C" configuration, which sandwich two gusset plates 53, one at the proximal end 37, and one at the distal end 39, of panel frame 36. Each of these channel members 41' and 41" are bolted to gusset plates 53 forming one rigid base member 41. Thereafter, two pieces of angle iron are turned back to back with their adjacent flat sections facing outward to form the flat vertical outside surface of support member 43. As with base member 41, support member 43 has two pieces of angled iron which sandwich a gusset plate 53 at the distal end 39 of panel frame 36, and a gusset plate 53 at the upper end 43' of support member 43 forming one rigid structural member having a flanged surface facing outward of the panel frame for receiving back drop panel 54. (FIG. 3) In like fashion, angled member 45 is constructed of two pieces of angle iron which sandwich gusset plates 53, one at the one proximal end 37 of panel frame 36, and one at the upper end 43' of support member 43 forming rigid angled member 45. First brace member 47 and second brace member 49 are single pieces of angle iron, and are bolted to smaller gusset plates 53' mounted on both support member 43 and angled member 45. Similarly, catwalk support 51 is also a single piece of angle iron which is bolted to both support member 43 and angled member 45.

After each of panel frames 36 has been constructed a "C" channel beam, bottom cross brace 56, is bolted between the mid-point of each of bottom members 41, as illustrated in FIGS. 1 and 4, and tie-rods 58. Tie-rods 58 are steel rods connected to base member 41 and bottom cross brace 56, one on each side of bottom member 41. Similarly, top cross brace 60 is a piece of angle iron which is bolted to the flat surface of the angle iron members comprising angled member 45.

As constructed, therefore, frame 30 is a lightweight yet rigid and durable structure which will be easy to construct due to the general light weight of its steel members, but yet will be durable due to its having been manufactured of steel, and due to the unity of the entire frame 30 once each of its components have been installed and connected to each other.

As with support base 20 and its structural components, frame 30 is constructed of conventional angle iron and structural steel. Frame 30 is finished with a primer coat of paint for corrosion protection, and can thereafter be finished in any exterior color required for safety, municipal codes or ordinances, or for aesthetic reasons.

As shown in FIG. 2 and FIG. 3, a backdrop panel 54 is mounted upon the outside surface of support member 43 facing away from central axis 15. Backdrop panel 54 is one continuous panel which encircles frame 30 along the circumference of a concentric circle about central axis 15. Backdrop panel 54 is finished in a black nonreflective surface. Backdrop panel 54 is provided so that as each of louvers 170 turn upon advertising sign 10, daylight will not be seen between the louvers to distract the viewer's attention from the billboard's messages forming the advertising sign.

As best shown in FIGS. 1 and 4, frame 30 is supported on support base 20, and hub support beam 22, by a plurality of vertical support wheel assemblies 62, horizontal support wheel assemblies 64, and idler wheel assemblies 66. Referring now to FIG. 4, 8 vertical support wheel assemblies 62 are bolted to bottom flange 32' of inner hub beam 32. Each of vertical support wheel assemblies 62 is spaced 45 degrees apart from each other about central axis 15. As best shown in FIG. 3, each vertical support wheel assembly 62 extends downward from bottom flange 32' of inner hub beam 32 so that the solid rubber tire wheel of the support wheel assembly rides on the top flange 24 of hub support beam 22.

As best illustrated in FIGS. 3 and 4, there are eight horizontal support wheel assemblies 64 which are mounted in four pairs of two on eight base members 41 of panel frames 36. Each horizontal support wheel assembly 64 is bolted to a wheel support 65. Wheel supports 65 are welded to base members 41. As best shown in FIG. 4, each of the horizontal support wheel assemblies 64 forming one of the four pair of assemblies is spaced 30 degrees apart from its adjoining horizontal support wheel. A sixty degree angle exists between each of the four pairs of horizontal support wheel assemblies 64. As shown in FIG. 3, the solid rubber wheel of horizontal support wheel assembly 64 rides on the outside of hub support beam web 26. Referring now to FIG. 4, a total of twenty-four idler wheel assemblies 66 are mounted on the top flange 28' of outer rim I-beam 28. Each of idler wheel assemblies 66 has a solid rubber wheel, and is spring loaded so that the rubber wheel stays in positive engagement with bottom flange 34' of outer rim beam 34 of frame 30. Each of idler wheel assemblies 66 are spaced 15 degrees apart about central axis 15.

As with idler wheel assemblies 66, vertical support wheel assemblies 62 and horizontal support wheel assemblies 64 are integrated wheel assemblies which each have spring loaded rubber wheels. Each of wheel assemblies 62, 64 and 66 are bolted to bottom flange 32', wheel support 65, and the top flange of outer rim I-beam 28, respectively. Each of the wheel assemblies is conventionally constructed, and no special requirements exist for these assemblies other than that they be spring-loaded and have solid rubber wheels. The rubber wheels deaden the sound of advertising sign 10 as it is rotated about central axis 15. The spring loading of each wheel assembly assures that advertising sign 10 is uniformly supported on the wheel assemblies.

Frame 30 is held on support base 20, and in particular upon inner hub support beam 22, by each of horizontal support wheel assemblies 64. As advertising sign 10 is being installed, support base 20, hub support beam 22, and outer rim I-beam 28 are erected on site. Frame 30 is then bolted together on the ground into one rigid assembly so that it may be lifted as an assembly and placed on hub support beam 22 and outer rim I-beam 28. However, frame 30 is not lowered onto support base 20 until idler wheel assemblies 66 have been bolted to outer rim I-beam 28, and vertical wheel support assemblies 62 have been bolted to bottom flange 32' of frame 30's inner hub beam 32. Once the respective wheel support assemblies, 62, 66, have been bolted into position, frame 30 is lowered onto support beam 22 and rim beam 28. Frame 30 is located on hub support beam 22 and outer rim I-beam 28 as precisely as possible about central axis 15. Wheel supports 65 are welded into their respective positions on bottom members 41 of panel flames 36, as indicated in FIGS. 3 and 4, and horizontal support wheel assemblies 64 are bolted into position. Once the sign has been properly centered on hub support beam 22 and outer rim I-beam 28, each of horizontal support wheel assemblies 64 rides upon the outside of hub support beam web 26, acting to fix frame 30 on hub support beam 22 and outer rim I-beam 28 so that advertising sign 10 will rotate about central axis 15 on its support wheel assemblies 62, 64 and idler wheel assemblies 66, respectively. Horizontal support wheel assemblies 64 prevent frame 30, and thus advertising sign 10, from wandering off of hub support beam 22 and outer rim I-beam 28.

Figure 5:
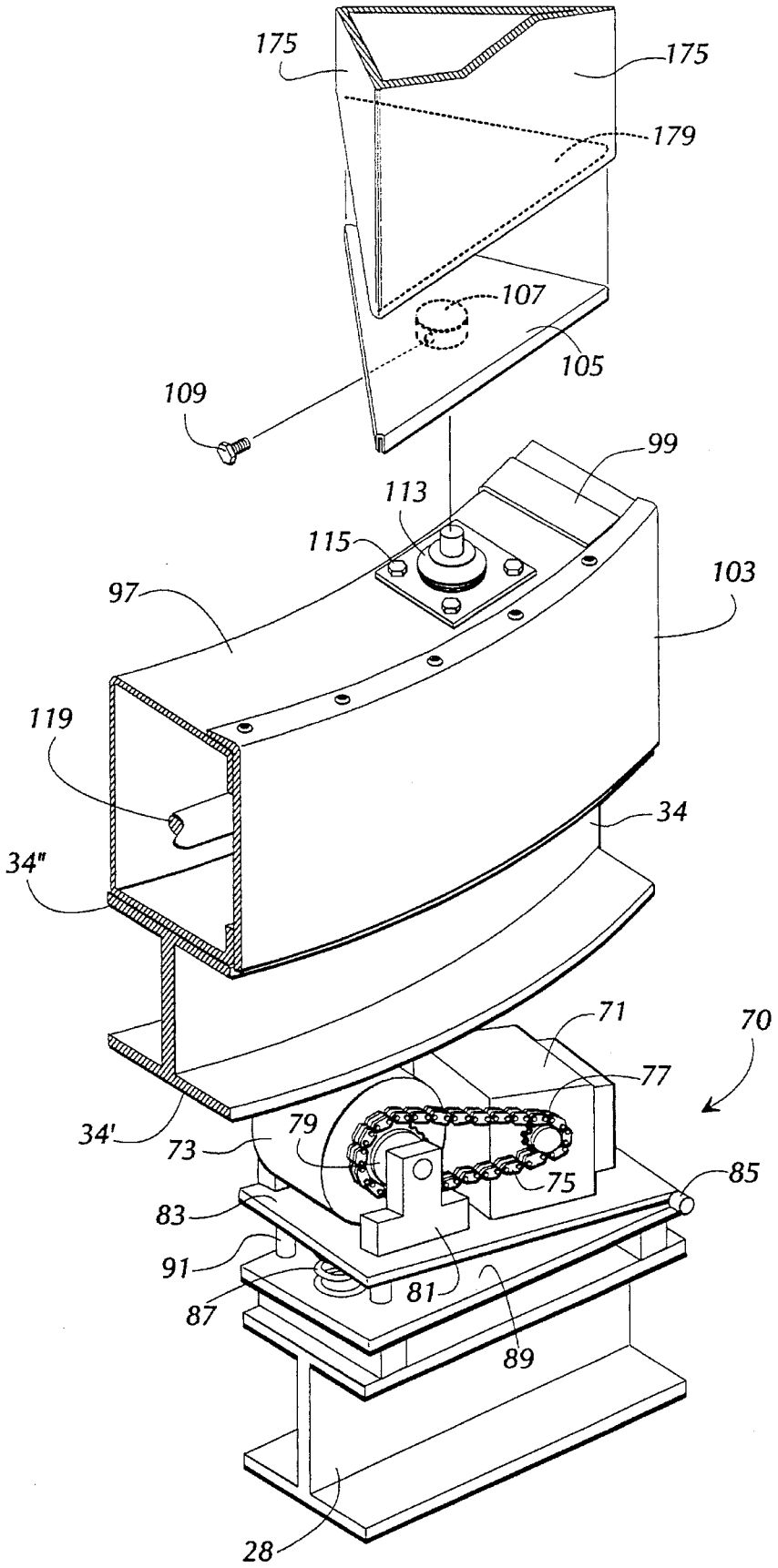
FIG. 5 is a partial perspective view of a drive wheel assembly used to rotate the advertising sign.

Frame 30 is driven by three drive wheel assemblies 70 as illustrated in FIG. 4. Referring now to FIG. 5, drive wheel assembly 70 is illustrated in greater detail. As shown in FIG. 5, drive wheel assembly 70 has an integral motor and gear box assembly 71 which powers drive wheel 73. Drive wheel 73 rides upon bottom flange 34' of frame 30's outer rim beam 34. Power is transmitted to drive wheel 73 by drive chain 75. Drive chain 75 is mounted on drive sprocket 77 which is connected to the output shaft (not illustrated) of motor-gear box assembly 71, and on a wheel sprocket 79 which is fastened to drive wheel 73. Drive wheel 73 is supported in position by a pair of drive wheel supports 81. Motor gear box assembly 71 and drive wheel supports 81 are bolted to base plate 83. Base plate 83 is slotted (not illustrated) so that drive wheel supports 81 can be shifted toward or away from motor gear box assembly 71 for taking the slack out of drive chain 75 during the installation of advertising sign 10.

Still referring to FIG. 5, base plate 83 is pivoted at its end closest to motor and gear box assembly 71 by a pivot connection 85. At its other end, underneath drive wheel 73, base plate 83 is supported in position by spring 87 which bears against the underside of base plate 83, and the top side of mounting plate 89. Mounting plate 89 is bolted, or welded, to outer rim I-beam 28. As best shown in FIG. 3, a pair of stops 91 are bolted at the end of base plate 83 opposite pivot connection 85 so that if, for whatever reason, spring 87 should fail, or spring 87 should be compressed for replacing drive wheel 73, base plate 83 will not collapse onto mounting plate 89. The primary purpose of spring 87 is to provide a compressive force for engaging drive wheel 73 on bottom flange 34' of outer rim beam 34.

As illustrated in FIG. 4, there are a total of three drive wheel assemblies 70 mounted onto outer I-beam 28. Each drive wheel assembly 70 is located 120 degrees apart from the others, on radial lines emanating from central axis 15.

Drive wheel assembly 70 is constructed of conventional materials. The electrical motor powering motor and gear box assembly 71 will be a ½ horsepower electrical motor. Motor and gearbox 71 will be so geared, through reduction gearing, that frame 30 of advertising 10 will rotate once every 15 minutes, for a total of four rotations about central axis 15 per hour. Drive chain 75 is a conventional power transmission chain drive used in heavy industrial or utility applications. Drive chain 75 can best be compared, however, to a bicycle chain in that it merely acts as a means for transmitting the geared down rotation of motor gear box assembly 71 to drive wheel 73. Drive wheel 73 is a solid rubber wheel supported on an axle (not illustrated) which is supported at each end by drive wheel supports 81.

As best shown in FIG. 5, drive sprocket 77 is located inside of one of drive wheel supports 81 and is fixed to the axle (not illustrated) on which drive wheel 73 is supported. Thus, as is seen in FIG. 5, drive wheel assembly 70 provides a simple, yet effective means for revolving advertising 10 about central axis 15. Although one has not been illustrated, drive wheel assembly can be fitted with a safety housing enclosing the drive wheel assembly with the exception of that portion of drive wheel 73 bearing on bottom flange 34'. A housing enclosing drive wheel assembly is not necessary, however, for the reason that motor and gear box assembly 71 is constructed as a weather tight integral assembly. Moreover, as illustrated in FIG. 3, frame 30 is encircled by frame skirt 202 which is mounted on support base 20 and encircles frame 30 along the circumference of a concentric circle about central axis 15, thus concealing idler wheel assemblies 66 and drive wheel assemblies 70.

Revolving louver assembly 94, illustrated in FIG. 1, is mounted on frame 30.

Revolving louver assembly 94 includes louver drive box assembly 96, louver drive system 132. A circular louver support beam 164 having a plurality of louver support pins 166, and a total of one hundred fourteen louvers 170 also form a part of revolving louver assembly 94.

Figure 6:
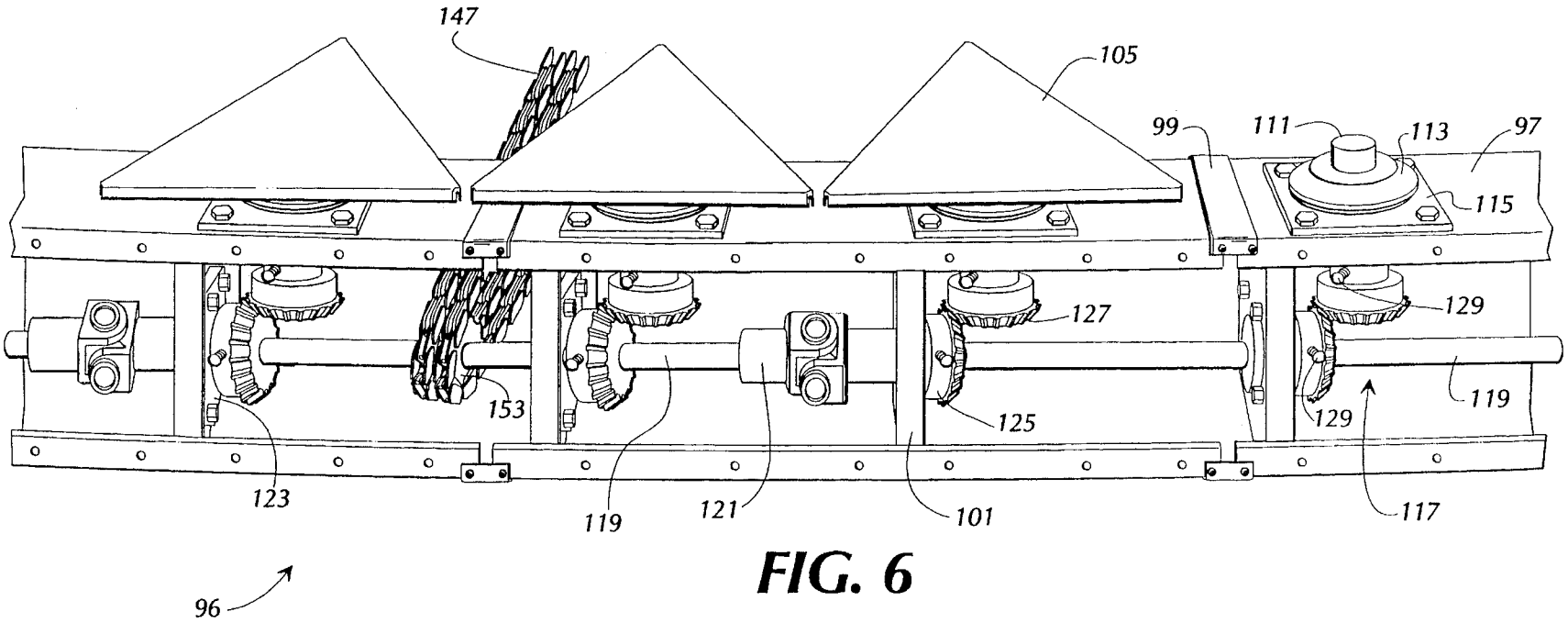
FIG. 6 is a partial perspective view of the louver drive box assembly of the advertising sign.

Louver drive box assembly 96, illustrated in FIG. 1, is revealed in greater detail in FIGS. 5 and 6. Referring now to FIG. 6, louver drive box assembly 96 is constructed of a plurality of box segments 97. Each box segment 97 is connected to each adjacent box segment by connecting straps 99 which are riveted to each of box segments 97. For ease in construction, rather than attempting to form a circular louver drive box assembly 96 of one piece, the actual louver drive box is formed of fifty-seven box segments 97. As illustrated in FIG. 6, each box segment 97 acts to support and house the rotational drive for two of louvers 170. By constructing louver drive box assembly 96 of fifty-seven box segments, the louver drive box can be constructed in circular fashion so that it lies along the circumference of a concentric circle about central axis 15. By using fifty-seven box segments 97, each box segment covers an arc of 6.32 degrees about the central axis. Covering an arc this small with each box segment 97, and then connecting the box segments 97 together with connecting straps 99, enables the louver drive box to be constructed so that it appears to be one solid circular drive box about central axis 15.

Still referring to FIG. 6, each of box segments 97 is constructed of one piece of sheet steel which is formed on a press. Each box segment 97 has a top horizontal surface, a vertical surface facing toward the central axis, and a lower horizontal surface which rests on top flange 34" of outer rim beam 34. Each box segment 97 also has two vertical flanges facing away from central axis 15 for receiving drive box cover 103. Each of box segments 97 is rigidly fastened to top flange 34" of outer rim beam 34 by welding or by bolts. It is intended that once louver drive box assembly 96 is mounted to frame 30, that it will not be readily removed.

As shown in FIG. 6, within each box segment 97 are two interior braces 101 which strengthen the louver drive box structure, and act to support louver drive shaft 117 as it passes through interior braces 101 around central axis 15. As illustrated in FIG. 5, the louver drive box assembly is enclosed by a drive box cover 103 which is fastened to each of box segments 97 by screws. In this manner, drive box cover 103 an be removed for inspection and servicing of louver drive box assembly 96, and any relevant portions of louver drive system 132.

Referring now to FIG. 6, and as described above, each of box segments 97 supports two of louvers 170. This is accomplished through a triangular louver base plate 105, which is connected to a turning shaft 111, and held in position by a set screw 109 (FIG. 5). As shown in FIG. 5, louver base plate 105 has a socket 107 welded or formed on the bottom of base plate 105 which is sized and shaped to receive turning shaft 111. Socket 107 of louver base plate 105 is placed on turning shaft 111, and set screw 109 is threaded through socket 107 into positive engagement with turning shaft 111 so that louver base plate 105 and turning shaft 111 form one integral assembly.

As shown in both FIGS. 5 and 6, turning shaft 111 is supported by a bearing 113. Bearing 113 is mounted in a bearing support plate 115, which is itself placed in one of two openings (not illustrated) defined in the top horizontal surface of each of box segments 97. Bearing support plate 115 is bolted to box segment 97. At the lower end of turning shaft 111 extending into the louver drive box, a second gear 127 is fastened to turning shaft 111, and held in place by a set screw 129.

Louver drive shaft 117 is supported within the louver drive box. Louver drive shaft 117 is constructed of fifty-seven shaft segments 119. Each shaft segment 119 has a universal joint 121 at one end for connection to the next shaft segment 119 forming louver drive shaft 117. By constructing louver drive shaft 117 of fifty-seven shaft segments 119, and fifty-seven universal joints 121, louver drive shaft 117 can be constructed as a circular drive shaft lying along the circumference of a concentric circle about central axis 15. By so doing, power can be effectively transmitted to each of the one hundred fourteen louvers forming a part of revolving louver assembly 94.

Still referring to FIG. 6, each of shaft segments 119 is passed through the two interior braces 101 of one box segment 97. Shaft segment 119 is supported by two bearing plates 123, one each in each of interior braces 101. Each bearing plate 123 has a bearing (not illustrated) supporting the shaft segment within that particular box segment 97. Since there are one hundred fourteen louvers on advertising sign 10, there are one hundred fourteen first gears 125 mounted on louver drive shaft 117. As shown in FIG. 6, there are two first gears 125 mounted on each shaft segment 119 of louver drive shaft 117. Each first gear 125 has a matching second gear 127 mounted on the lower end of turning shaft 111 for turning each one of louvers 170 about their length. Each of first gears 125 is fastened to louver drive shaft 117 by set screws 129. Similarly, each of second gears 127 is also fastened to turning shaft 111 by set screws 129. As illustrated in FIG. 6, each first gear 125 and each second gear 127 are 45 degree bevel gears.

In operation, as louver drive shaft 117 rotates, each of first gears 125 rotates thus turning each of second gears 127, which in turn will rotate turning shaft 111 supported in bearing 113, so that louver base plate 105 rotates about the axis of turning shaft 111. The axis (not illustrated) of turning shaft 111 is in alignment with the axis 170' (FIG. 1) of each of louvers 170.

Figures 7, 8:
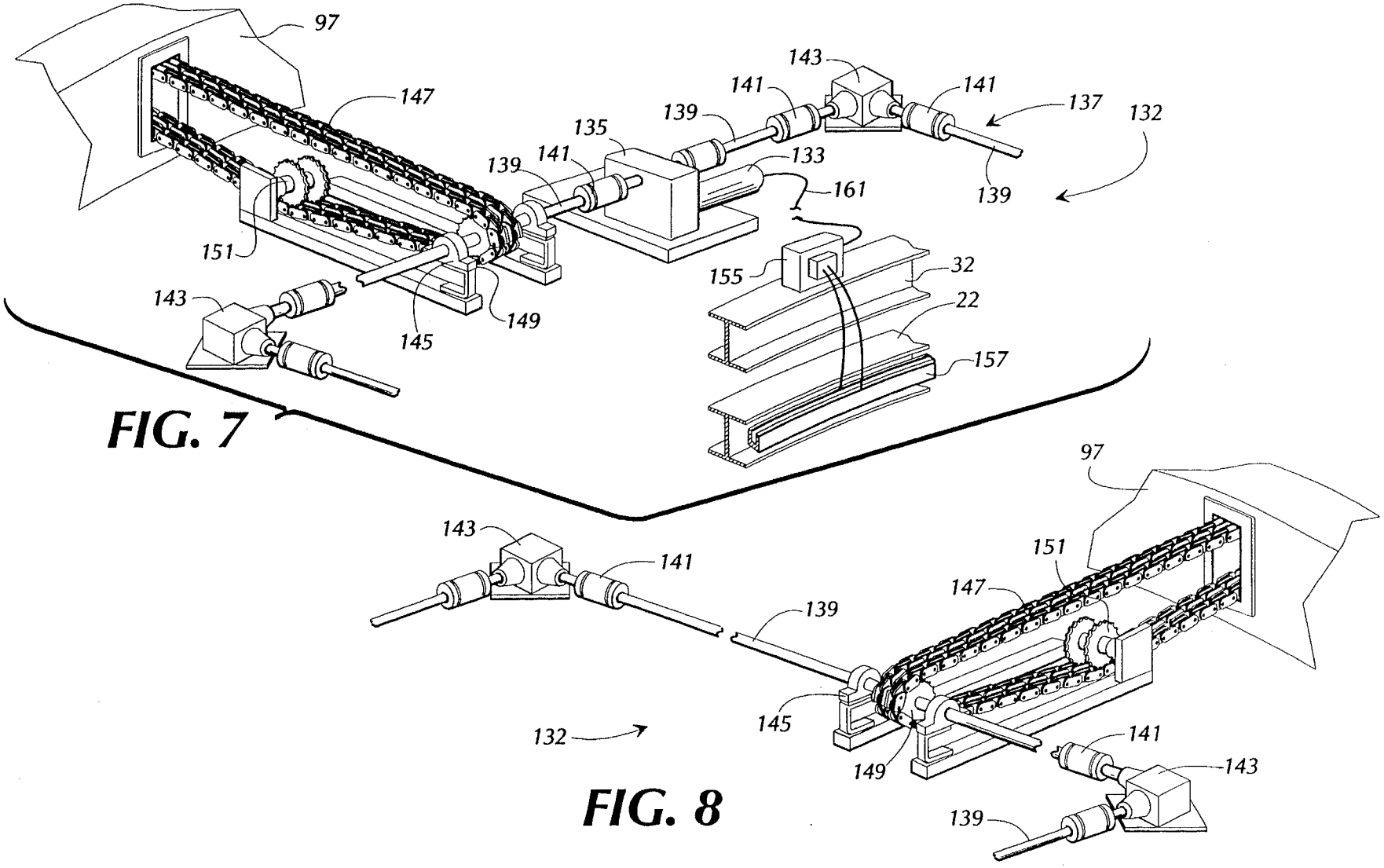
FIG. 7 is a perspective view in partial detail of the louver drive system of the advertising sign.
FIG. 8 is a second perspective view in partial detail of the louver drive system of the advertising sign.

Louver drive system 132 of revolving louver assembly 94, shown in partial detail in FIG. 1, is shown in greater detail in FIGS. 7 and 8. Turning now to FIG. 7, louver drive system 132 has a louver drive motor 133, and a reducing gear box 135 which are mounted on frame 30 (FIG. 2). A first drive shaft 137 is provided as a part of louver drive system 132. First drive shaft 137 is constructed of four steel drive rods 139, each drive rod 139 can have any number of rod segments, as the rods are fastened by connectors 141 to form four drive rods 139, one for each side of a square, mounted on frame 30 (FIG. 2).

Louver drive motor 133 drives gear box 135, which in turn will rotate first drive shaft 137. As first drive shaft 137 comes to a corner, four right angle gear boxes 143 are provided so that first drive shaft 137 may turn 90 degrees and continue onward to form a square. See FIG. 2, where louver drive system 132 is illustrated in top plan view, showing that first drive shaft 137 indeed forms a square within the circle formed by frame 30. Each of rods 139 are supported by two drive shaft support bearings 135, which are in turn mounted on frame 30. A drive chain mechanism 146 is provided in the middle of each rod 139.

There are four drive chain mechanisms 146 provided as a part of louver drive system 132. As best shown in FIGS. 7 and 8 each drive chain mechanism 146 has a drive chain 147 which is powered by a drive sprocket 149 mounted on each rod 139. Idler sprocket 151 engages drive chain 147 and takes the slack out of the drive chain so that it will drive louver drive shalt 117 efficiently. A louver drive shaft sprocket 153, illustrated in FIG. 6, is provided at four locations 90 degrees apart from one another on louver drive shaft 117 for transmitting the power of louver drive motor 133 and louver gear box 135 to louver drive shaft 117.

Louver drive motor 133 and louver gear box 135 are mounted on frame 30 in conventional fashion. Similarly, each of the four drive chain mechanisms is mounted on frame 30 through the use of structural steel or angle iron members in conventional fashion. Each of idler sprockets 151 can be moved upon its support base so that the slack can be taken out of each of drive chains 147. Also, although it is not illustrated, drive chains 147 could stretch over time to the point that idler sprockets 151 cannot take the slack out of the drive chain. If so, the drive chains 147 may have a link removed to shorten the drive chain to prolong its service life and avoid the necessity of replacing the drive chain any sooner than necessary. Each of drive chains 147 is similar to drive chain 75 of drive wheel assembly 70, and is a conventional power transmission chain drive.

As shown in both FIGS. 7 and 8, drive chain 147 enters the back of box segment 97 through a rectangular opening defined therein and is received upon a louver drive shaft sprocket 153, as shown in FIG. 6. This is also shown in FIG. 2, where all four of drive chain mechanisms 146 are illustrated as being mounted on frame 30 with their drive chains 147 extending to louver drive shaft 117.

Referring now to FIG. 7, Louver drive system 132 also includes motor drive control 155. Motor drive control 155 is a programmable solid state system which can be programmed so that the louver drive system 132 will properly index itself and turn louver drive shaft 117 so that each louver 170 is aligned to display an advertising sign outward of central axis 15 along the circumference of a concentric circle about central axis 15. It is also anticipated that motor drive control 155 can be programmed so that the louver drive system may skip one of the three faces (FIG. 1) of a louver 170, for instance where only two billboards are contained on two of the three sides 175 (FIG. 1) of louver 170. Similarly, motor drive control 155 can be programmed so that the louvers continually rotate, although it is not intended that this happen as it would be undesirable from an advertising standpoint to provide an advertising sign where the louvers continually rotated.

As we have constructed our invention, motor drive control 155 will activate louver drive system 132 so that each of louvers 170 are simultaneously rotated about their lengths. It is anticipated that it will take three seconds for each of louvers 170 to rotate while louver drive system 132 is in operation. Thereafter, louver drive system 132 is stationary so that each of louvers 170 remains stationery and displays a panel 175 facing outward of central axis 15 for a set display period. This display period can be extended or shortened. The actual timing requirements of louver drive system 132 can be adjusted to suit the needs of the advertising sign owner, or the advertisers who have marketed space upon the sign. Also, the timing requirements of louver drive system 132 may be dependent upon municipal codes or ordinances which will dictate the frequency with which louvers 170 of advertising sign may rotate.

Motor drive control 155 receives power from commutator ring 157, which is itself formed in the shape of a concentric circle about the central axis. Two conventional pickup wipers 159 extend from motor drive control 155, providing power to motor drive control 155 from the commutator ring. Commutator ring 157 is a is conventional commutator ring assembly, and wired to receive power from the same electrical source providing the power for each of drive wheel assemblies 70. A pair of motor leads 161 extend from motor drive control 155 to louver drive motor 133.

The components of louver drive system 132 are conventional. No special requirements exist with regard to the hardware or mechanisms which comprise louver drive system 132. In order to avoid frequent maintenance, it is anticipated that each of right angle gear boxes 143 will be a sealed gear box so that outside dirt and debris cannot enter the gear box, which will be holding a supply of lubricants for the gears therein. Connectors 141 are solid connectors which will be fastened to rods 139 by set screws, or may be bolted or welded to the rods. Each of rods 139 are solid steel rods. The exposed steel surfaces of louver drive system 132 will be painted to protect the steel from the elements, and to extend the service life of the louver drive system.

Referring now to FIGS. 1 and 3, revolving louver assembly 94 also includes louver support angle 162 which is welded to upper end 43' of panel frame 36's support member 43. Each of the twelve panel frames 36 will have a louver support angle 162 welded thereto. A circular louver support beam 164 is then connected to the underside of each louver support angle 162. Louver support beam 164 can be welded or bolted to support angle 162. Louver support beam 164 is sized and shaped to lie along the same circumferential line of concentric circle about the central axis as louver drive box assembly 96. Moreover, louver support beam 164 is in vertical alignment with louver drive box assembly 96 so that each of louvers 170 is held in an upright vertical position.

As illustrated in FIGS. 1 and 3, a total of one hundred fourteen louver support pins are fastened to the underside of louver support beam 164. Each of louver support pins 166 is bolted to louver support beam 164. Moreover, each support pin 166 is vertically aligned with the axis (not illustrated) of each of the turning shafts 111 mounted to louver drive box assembly 96. Louver support angle 162, louver support beam 164, and louver support pins 166 are conventionally constructed of steel, and are painted with a prime coat to protect them from the elements, and can be painted with any finish coat to match the remainder of advertising sign 10.

The final component of revolving louver assembly 94 are the louvers 170. As stated previously, there are a total of one hundred fourteen louvers on advertising sign 10. Each louver is 14 feet in height, and each louver panel 175 is one foot wide. Each of louvers 170 is constructed of aluminum.

Referring now to FIG. 1, each louver 170 has a first end 171, and a second end 173. Louver 170 is constructed of three louvers panels 175 (FIG. 5) which are constructed to form a hollow triangular conduit 14 feet high with sides one foot long. Top plate 177 is connected to each of louver panels 175 along their common horizontal edges at the first end 171 of louver 170. A circular opening 178 is defined in the center of top plate 177 along the axial line 170' (FIG. 1) of louver 170. Circular opening 178 is fitted with a bushing (not illustrated) sized and shaped to receive a louver support pin 166. Similarly, bottom plate 179 is welded to each of louver panels 175 at the second end of louver 170. However, and as best illustrated in FIG. 5, bottom plate 179 is recessed inward of the second end 173 of louver 170, for reasons which will be described below. Top plate 177 and bottom plate 179 are made of aluminum.

As illustrated in FIGS. 1 and 3, each louver 170 has four sign clips 181 located at the center of each horizontal and vertical face of each louver panel 175, respectively. Sign clips 181 are conventional sign clips used to hold advertising billboards on revolving louver displays.

Each louver 170 is mounted on revolving louver assembly 94 in the following fashion. Louver 170 is stood upright, and the first end 171 of louver 170 having top plate 177 with circular opening 178 is passed over a louver support pin 166. Thereafter, the louver is lowered down onto louver base plate 105. Due to the fact bottom plate 179 has been recessed inward from the second end 173 of louver 170, louver 170 passes over and encloses louver base plate 105 on its horizontal top and vertical side surfaces. This is illustrated in FIG. 3, where second end 173 of louver 170 passes down and over louver base plate 105. This is done for each one of louvers 170 which make up the louver array forming the billboard advertising display surface of advertising sign 10.

As shown in FIG. 2, advertising sign 10 is encircled by an external horizontal catwalk 184. Catwalk 184 is supported on support base 20. Catwalk 184 is formed of aluminum or steel grating. Connected to the outside periphery of external catwalk 184 are 24 exterior lights 186, which will illuminate advertising sign 10 during evening hours. As discussed previously, an internal catwalk 188 is mounted on each of catwalk supports 51 attached to each of panel frames 36, forming a generally horizontal and circular catwalk inside of support members 43 of panel frames 36. This is illustrated in FIG. 2 and FIG. 3.

Advertising sign 10 also has an advertising structure 190 which is mounted upon a plurality of, in this instance four, vertical support columns 192 which extend downward and are fastened to support base 20. The advertising structure 190 shown in FIG. 1 is in the shape of a peach. Advertising structure 190 is constructed of sixteen (16) fiberglass ribs 191, having a textured surface. Advertising structure 190 is otherwise open. It is intended that advertising structure 190 can take the shape of any local product or symbol of the community in each locale where advertising sign 10 is installed.

As shown in FIG. 3, a number of interior lights 194 are provided on each of panel frames 36, or on any combination of panel frames 36, for illuminating advertising structure 190. Advertising structure lights 194 will be controlled by a light control box 196, which will be a conventional electrical control circuit. It is anticipated that light control box 196 will be equipped with a remote control modem (not illustrated), for example a radio modem, a cellular telephone modem, or a conventional hard wired telephone line into a modem, or other conventional receiving and activating device so that advertising structure lights 194 could be activated to illuminate advertising structure 190 on demand, or in response to pre-programmed conditions. Moreover, advertising structure lights 194 are provided in more than one color. For example, one of advertising structure lights 194 in FIG. 3 will be red to indicate warm weather, one will be blue to indicate cold weather, and one will be peach colored to indicate pleasant weather. Of course, any combination of colors, to include a uniform color, for example white, is possible dependent upon both the advertising sign owner's and the advertisers' needs or requirements.

As shown in FIG. 3, advertising sign 10 can be supplied with a drop pin 200 which can be used to lock frame 30 into position so that it may not be rotated about central axis 15 during the time in which advertising sign 10 is being serviced; or when, for example, advertising billboards are being clipped to louvers 170. Drop pin 200 extends through base member 41 and into support base 20 for locking frame 30 into position. It is possible that more than one drop pin 200 can be provided for locking frame 30 into position. Lastly, and as described previously, a frame skirt 202 is provided on support base 20 just outside of frame 30 which encircles frame 30 in order to conceal idler wheel assemblies 66, drive wheel assemblies 70, illustrated in FIG. 4, and louver drive box assembly 96 illustrated in FIGS. 3 and 5.

In operation, frame 30 of advertising sign 10 will rotate about central axis 15 once every fifteen minutes. This time period can be adjusted, however. As described previously, frame 30 is driven by the three drive wheel assemblies 70 mounted on outer rim I-beam 28. During the time in which frame 30 is rotating about central axis 15, each of louvers 170, carried upon revolving louver assembly 94, mounted to frame 30, is rotated about its length. Each louver 170 will rotate in unison, and each louver 170 will display one of three advertising signs outwardly of the central axis at different times during the sign's rotation. Louvers 170 may be rotated clockwise or counterclockwise. This can be programmed through motor drive control 155. There is no particular manner in which louvers 170 need be rotated.

During operation of advertising sign 10 during evening time, or during inclement weather, exterior lights 186 can be turned on to light up louver panels 175 which will be outwardly displaying an advertising billboard sign on advertising sign 10. Also, if so equipped and if so desired, advertising structure 190 can also be illuminated for drawing attention to advertising sign 10. It is also anticipated that advertising sign 10 can be constructed of louvers 170 made of a rigid translucent material for illuminating louvers 170 from inside each louver.

When it is desired to service the sign, or to change the billboard display panels on louver 170, drop pin 200 can be placed into position through base member 41 and into support base 20 alone, or in conjunction with an electrical lock-out switch which will prevent power from reaching any one of drive wheel assemblies 70. It is also possible to equip advertising sign 10 with a separate electrical lock-out to prevent power from reaching either motor drive control 155 or louver drive motor 133 of louver drive system 132. However, it is desirable to have power available to the louver drive system so that the louvers can be rotated during the changing of the advertising billboard displays on the sign. Motor drive control 155 will be equipped with a manual override so that louvers 170 can be rotated to display one of their three faces 175 at any one time, and hold that position while the sign is being serviced.

Referring now to FIGS. 1 and 2, frame 30 of our invention is forty (40) feet in diameter. External catwalk 184 is five (5) feet wide, and encircles the frame. Therefore, advertising sign 10 has a total diameter of fifty (50) feet. We do wish to point out, however, that we do not limit our invention to the dimensions of the components and assemblies disclosed herein. The concept of our advertising sign 10 can be applied to advertising signs of any size to best suit the sign owner's needs.

Thus, it can be seen that the present invention comprises a useful and effective advertising sign which is both novel and will be easily seen and remembered by the public. While the invention has been shown and described as what is presently believed to be the most practical and preferred embodiments thereof, it will be apparent that modifications and variations within the scope and spirit of the disclosed embodiment are possible, and that the invention is to be afforded the interpretation so as to encompass all of the equivalents thereof, as set forth in the following claims.

We claim:

1. An advertising sign comprising:

a generally circular frame formed about a generally upright central axis, said circular frame defining a circular opening about said central axis;

means for supporting said frame for rotation about said central axis;

a plurality of multiple sided elongated louvers each rotatably supported by said frame with the louvers being vertically disposed in an array about said central axis adjacent one another for forming a sign surface;

drive means for rotating said frame about said central axis and means for rotating said louvers about their lengths whereby the louvers rotate on said frame about their lengths and revolve with said frame about said central axis;

said circular frame including:

a plurality of panel frames spaced equally apart from one another and extending radially about said central axis, each of said panel frames having a proximal end adjacent said central axis and a distal end remote from said central axis;

a circular inner hub beam to which the proximal end of each of said panel frames is connected; and a circular outer rim beam to which the distal end of each of said panel frames is connected, said inner hub beam and said outer rim beam being formed concentrically about said central axis;

said distal end of each of said panel frames including a generally upright support member, each of said support members being disposed on said circular frame in a circular array about said central axis; and an upper louver support beam mounted on said support members extending concentrically about said central axis and supporting said louvers for rotation whereby, said circular frame rotates about said central axis and the louvers move with said circular frame and revolve about said central axis and the louvers rotate into position for outwardly displaying different images at different times.

2. The advertising sign of claim 1, further comprising a continuous backdrop panel mounted on the distal end of each of said panel frames inward of said louvers and facing outward of the central axis along the circumference of a concentric circle about said axis.

3. The advertising sign of claim 1, further comprising a generally horizontal internal catwalk about said axis and mounted on each of said panel frames inward of said support members and said louvers for providing a work platform for servicing said advertising sign from within said frame.

4. The advertising sign of claim 1, wherein said means for supporting said circular frame further comprises:

a support base;

a plurality of spaced apart support wheels mounted on said inner hub beam and engaged with said support base;

a plurality of spaced apart idler wheels mounted on said support base below and engaged with said circular outer rim beam of said circular frame;

said support wheels and said idler wheels being constructed and arranged to rotatably support said circular frame on said support base, said support wheels being further constructed and arranged to hold said circular frame on said support base for rotation about said central axis.

5. The advertising sign of claim 4, wherein said drive means for rotating said circular frame about said axis further comprises at least one drive wheel assembly disposed upon said support base below and engaged with said circular outer rim beam for rotating said frame about said axis.

6. The advertising sign of claim 4, further comprising a generally horizontal external catwalk mounted on said support base and encircling the advertising sign.

7. The advertising sign of claim 6, further comprising a plurality of lights mounted upon said exterior catwalk for illuminating the advertising sign.

8. The advertising sign of claim 4, further comprising:

a plurality of vertical support columns mounted upon said support base and disposed within said circular opening of said circular frame about the central axis; and an advertising structure mounted on said columns and visible above said circular frame.

9. The advertising sign of claim 8, further comprising a plurality of multiple colored lights disposed upon said circular frame for illuminating said advertising structure.

10. The advertising sign of claim 9, further comprising means for selecting and activating said multiple colored lights for illuminating said advertising structure so that said advertising structure may be illuminated with lights of one uniform color at different times.

11. The advertising sign of claim 8, wherein said advertising structure further comprises a three-dimensional shaped structure.

12. The advertising sign of claim 1, wherein each of said louvers rotatably supported by said circular frame is disposed along the circumference of a concentric circle about the central axis.

13. The advertising sign of claim 12, wherein each louver further comprises:

three rectangular louver panels, each of said louver panels having a pair of spaced vertical side edges, each said louver panel being joined to adjacent of said louver panels along said vertical side edges to form a hollow triangular conduit having a first end and second end;

a top plate and a bottom plate mounted to said triangular conduit at said first end and said second end, respectively, wherein said top plate defines a circular opening about its center, and said bottom plate is recessed in said conduit inward of said second end; and fastening means disposed along the edges of each louver panel for removably retaining an advertising sign panel.

14. The advertising sign of claim 13, wherein said upper louver support beam further comprises:

a plurality of louver support pins disposed upon said upper louver support beam and extending downwardly toward said circular rim beam, wherein each of said pins is received one each within said circular opening in each of said louver top plates; and a plurality of louver base plates rotatably mounted on said frame, wherein said recessed bottom plate of one each of said louvers is received on one each said base plates.

15. The advertising sign of claim 1, wherein said means for rotating said louvers about their lengths further comprises:

a louver drive motor mounted on said circular frame;

a first drive shaft supported on said circular frame and connected in driving relationship to said drive motor;

a louver drive shaft supported upon said circular frame and connected in driving relationship to said first drive shaft;

a plurality of first gears mounted on said louver drive shaft, one each for each of said louvers supported on said circular frame;

a plurality of second gears connected to said louvers, wherein there is one second gear for each of said louvers, and wherein each of said second gears is engaged with one each of said first gears for rotating said louvers about their length; and control means, disposed upon said circular frame, for rotating said louvers into fixed positions for outwardly displaying different advertising signs at different times.

16. The advertising sign of claim 15, wherein each of said first and second gears further comprises a 45 degree bevel gear for transmitting a rotational movement of said louver drive shaft to each of said louvers.

17. The advertising sign of claim 15, wherein said louver drive shaft is mounted on the distal end of each of said panel frames, and wherein said first drive shaft is disposed along the circumference of a concentric circle about said axis.

18. The advertising sign of claim 15, wherein said control means further comprises means for intermittently powering and idling the louver drive motor so that said louvers rotate into a fixed position outward of said axis for displaying the advertising sign, hold that position, and are then rotated into the next sequential display position.

19. The advertising sign of claim 1, further comprising means for locking said circular frame into a fixed position so that the circular frame cannot be rotated during servicing of the apparatus.

20. The advertising sign of claim 19, wherein said means for locking said circular frame into position further comprises at least one drop pin extending downwardly from at least one of said panel frames so that said drop pin may be fixedly engaged with said support means so as to prevent rotation of said circular frame.

21. A progressively changeable cylindrical sign for displaying outwardly directed progressively changeable visual images, comprising:

a plurality of three sided elongated louver assemblies arranged parallel and side-by-side in a cylindrical array to form a carousel of louvers;

said louvers each having visual images which correspond with the visual images of adjacent louvers to form a comprehensive coherent progressive outwardly directed image about said carousel;

rotating means for rotating each louver about its length in timed relationship with the others of the louvers, independently of the movement of the carousel of louvers, to form different outwardly directed images;

revolving means for continuously revolving said carousel about an axis central to said carousel to move the louvers and the outwardly directed image formed by the louvers progressively about the carousel;

a plurality of generally vertical support columns extending through the sign, said support columns being generally parallel to said axis about which the sign revolves; and an advertising structure mounted on said columns and visible above the sign.

22. A process of displaying a progressively changing image comprising:

arranging a plurality of elongated louver assemblies parallel to one another in a cylindrical array on a carousel;

continuously revolving the louver assemblies on the carousel about an axis central to said carousel;

turning the louvers about their lengths in timed relationship with each other independently of the revolution of the carousel to form progressively changing outwardly directed coherent images about the carousel; and positioning an advertising structure with respect to said carousel so that said advertising structure is visible above said carousel.

23. An advertising sign for displaying outwardly directed progressively changeable visual images, comprising:

a circular frame, said circular frame being sized and shaped as a generally cylindrical frame defining an enlarged circular opening at its center about a central axis;

said circular frame further comprising a plurality of panel frames spaced equally apart from each other radially about said axis, wherein each of said panel frames has a proximal end and a distal end, a circular inner hub beam to which the proximal end of each of said panel frame is connected, and a circular outer rim beam to which the distal end of each of said panel frames is connected, said inner hub beam and said outer rim beam in a common plane about said axis;

means for supporting said circular frame for rotation about said axis;

drive means for continuously rotating said circular frame about said axis;

a plurality of multiple sided elongated louvers each rotatably supported by said circular frame arranged adjacent one another in side-by-side relationship in a cylindrical array about said axis for forming different outwardly directed images;

means for rotating said louvers about their lengths whereby the louvers rotate on said circular frame and revolve about said central axis;

whereby, the circular frame rotates about the central axis and the louvers move with said circular frame and revolve about said central axis and the louvers rotate into position for outwardly displaying different images at different times.

24. The advertising sign of claim 23, wherein the distal end of each of said panel frames further comprises a generally upright support member, and wherein each of said support members is disposed along the circumference of a concentric circle about said axis.

25. The advertising sign of claim 23, further comprising:

a support base positioned below said circular frame;

a plurality of generally vertical support columns mounted on said support base and extending through said circular opening of said circular frame generally parallel to said central axis; and and advertising structure mounted on said columns and visible above said circular frame.

26. A revolving sign assembly comprising:

a frame structure having a generally polygonal shape;

said frame structure having an outer circumference and an inner circumference;

a carriage assembly for supporting and for permitting rotation of said frame structure, said carriage assembly including an outer circular beam for supporting said frame structure about said outer circumference and an inner circular beam concentrically positioned relative to said outer circular beam for supporting said frame structure about said inner circumference of said frame structure;

means for driving said frame structure to rotate upon said carriage assembly;

a plurality of elongated vertical panel members rotatably mounted about said outer circumference of said frame structure;

means for rotating said plurality of elongated members at predetermined angular increments.

* * * * *